US008931301B2

(12) United States Patent
Lee et al.

(10) Patent No.: US 8,931,301 B2
(45) Date of Patent: Jan. 13, 2015

(54) MOVABLE REFRIGERATOR

(75) Inventors: Namgi Lee, Seoul (KR); Sungil Park, Seoul (KR)

(73) Assignee: LG Electronics Inc., Seoul (KR)

( * ) Notice: Subject to any disclaimer, the term of this patent is extended or adjusted under 35 U.S.C. 154(b) by 209 days.

(21) Appl. No.: 13/580,578

(22) PCT Filed: Feb. 21, 2011

(86) PCT No.: PCT/KR2011/001119

§ 371 (c)(1),
(2), (4) Date: Aug. 22, 2012

(87) PCT Pub. No.: WO2011/105719

PCT Pub. Date: Sep. 1, 2011

(65) Prior Publication Data

US 2012/0318016 A1 Dec. 20, 2012

(30) Foreign Application Priority Data

Feb. 23, 2010 (KR) ..... 10-2010-0016379

(51) Int. Cl.
*F25D 3/08* (2006.01)
*F16H 57/00* (2012.01)
*F25D 11/00* (2006.01)

(52) U.S. Cl.
CPC ..... *F25D 11/00* (2013.01); *F25D 2400/32* (2013.01); *F25D 2400/38* (2013.01)
USPC ..... 62/457.1; 74/405

(58) Field of Classification Search
CPC ... F25D 2400/38; F25D 3/06; F25D 2400/08; F25D 2400/32; F25D 3/08; F16D 2125/20; F16D 2125/24
USPC ..... 62/378, 297, 457.1; 74/29, 405
See application file for complete search history.

(56) References Cited

U.S. PATENT DOCUMENTS

| | | | | |
|---|---|---|---|---|
| 4,484,649 | A * | 11/1984 | Kennedy et al. | 180/216 |
| 4,741,221 | A * | 5/1988 | Hudimac, Jr. | 74/424.9 |
| 6,177,770 | B1 * | 1/2001 | Feygin | 318/9 |
| 6,502,656 | B2 * | 1/2003 | Weiss et al. | 180/168 |
| 2005/0110373 | A1 | 5/2005 | Assmann | |
| 2007/0193295 | A1 | 8/2007 | Hansen et al. | |
| 2008/0190242 | A1 * | 8/2008 | Kim et al. | 74/84 R |
| 2010/0231105 | A1 | 9/2010 | Latif | |

FOREIGN PATENT DOCUMENTS

| | | |
|---|---|---|
| JP | 2002-119337 A | 4/2002 |
| JP | 2009-526195 A | 7/2009 |

* cited by examiner

*Primary Examiner* — Frantz Jules
*Assistant Examiner* — Steve Tanenbaum
(74) *Attorney, Agent, or Firm* — Birch, Stewart, Kolasch and Birch, LLP

(57) ABSTRACT

Disclosed herein is a movable refrigerator including a main body travel driving unit configured to automatically rotate the wheel to move the main body and a main body travel switching unit configured to turn on or off the main body travel driving unit to automatically or manually move the main body. Accordingly, the user may suitably select and use automatic operation and manual operation according to the user's healthy condition, the environment of the used place, or the need of use, thereby greatly enhancing the use convenience of a movable refrigerator.

7 Claims, 4 Drawing Sheets

MOVABLE REFRIGERATOR

TECHNICAL FIELD

The present disclosure relates to a movable refrigerator, and more particularly, to a movable refrigerator capable of automatic and manual movement.

BACKGROUND ART

A movable refrigerator is used to assist a typically used home refrigerator, which is smaller than a floor-mounted refrigerator and includes a moving means such as a carrier or wheel. Such a movable refrigerator can be used at various places contrary to a typical stationary refrigerator, and thus widely used for outdoor activities such as travel or leisure, and also used as a dedicated refrigerator for storing a specific product even in general households.

Such a movable refrigerator may cool stored products in various ways, which can be classified into a type in which thermal insulation material such as ice or an ice pack is inserted to provide cooling for a predetermined period of time, and a type in which a battery or external power is supplied to provide cooling by operating a built-in freezing system.

Of them, a movable refrigerator having a freezing system may include a main body having a storage space therein and a cooling apparatus incorporated in the main body. Furthermore, a shelf for mounting cooling objects is placed in the storage space, and a door for opening or closing the storage space is also placed therein.

The door may be placed at a lateral surface or upper portion of the main body. In case where the door is placed at a lateral surface of the main body, it may have good accessibility to the inside of the storage space but the rigidity of the main body may be reduced when the door is open since the door itself constitutes part of the main body. Moreover, the door may be open during the moving process if a suitable locking apparatus is not used.

In case where the door is placed at an upper portion of the main body, the main body forms a cylindrically-shaped integral structure, thereby providing high rigidity, and the own weight of the door itself is adhered to the main body, thereby providing good sealability. However, when a lot of products are stored in case where the door is placed at the upper portion thereof, there is a problem that it is not easy to take out a product placed at the lowest portion thereof, causing difficulty in effectively using the storage space.

DISCLOSURE OF INVENTION

Technical Problem

The foregoing movable refrigerator in the related art may have a problem that the refrigerator should be pulled and moved directly by the user to be used and thus it may be difficult to be pulled and moved because the weight of the refrigerator is heavy when foods are stored in the storage space of the refrigerator. In particular, it may be more difficult to move the refrigerator when the storage capacity of the refrigerator is large, the user is an elderly or disabled person, or the place to be moved is inclined.

Solution to Problem

The present invention is contrived to solve the foregoing problems in a movable refrigerator in the related art, and an aspect of the present disclosure is to provide a movable refrigerator that can be easily moved as well as pulled and moved directly by the user as the need arises.

In order to accomplish the foregoing objective, there is provided a movable refrigerator including a main body having a storage space therewithin and having a wheel at a lower portion thereof; a cooling apparatus provided within the main body to cool the storage space; a shelf provided in the storage space to accommodate foods; a main body travel driving unit configured to automatically rotate the wheel to move the main body; and a main body travel switching unit configured to turn on or off the main body travel driving unit to automatically or manually move the main body.

Accordingly, the user may suitably select and use automatic or manual operation according to the user's healthy condition, the environment of the used place, or the need of use, thereby greatly enhancing the use convenience of a movable refrigerator.

Advantageous Effects of Invention

Disclosed herein is a movable refrigerator including a main body travel driving unit configured to automatically rotate the wheel to move the main body and a main body travel switching unit configured to turn on or off the main body travel driving unit to automatically or manually move the main body. Accordingly, the user may suitably select and use automatic operation and manual operation according to the user's healthy condition, the environment of the used place, or the need of use, thereby greatly enhancing the use convenience of a movable refrigerator.

BEST MODE FOR CARRYING OUT THE INVENTION

Hereinafter, a movable refrigerator according to the present disclosure will be described in detail with reference to the accompanying embodiment.

Figure 1:
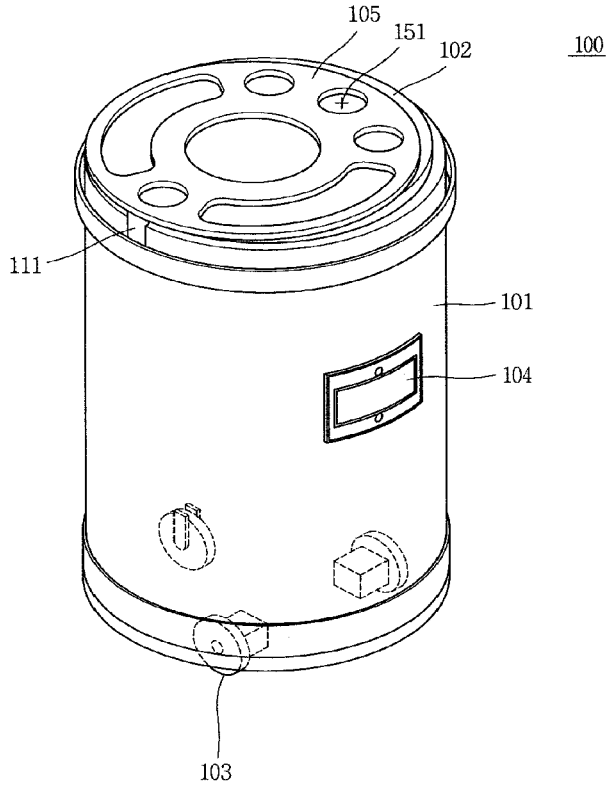
FIG. 1 is a perspective view illustrating the external appearance of a movable refrigerator according to an embodiment of the present disclosure.

FIG. 1 is a perspective view illustrating the external appearance of a movable refrigerator according to an embodiment of the present disclosure. Referring to FIG. 1, a movable refrigerator 100 according to the present disclosure may include a main body 101 having a cylindrical shape as a whole and a cap 102 having a disk shape located at an upper portion of the main body 101. Furthermore, a wheel 103 for movement is mounted at a lower surface of the main body 101, and a display window 104 for displaying an operating state of the movable refrigerator is provided at a lateral surface thereof. A manipulation button for manipulating the main body 101 may be provided on the display window 104.

A tray 105 may be provided at an upper portion of the cap 102. The tray 105 also has a disk shape as a whole, but a plurality of container fixing grooves 151 are concavely formed on the upper side surface. The tray 105 is provided to allow an upper surface of the movable refrigerator 100 to be used as a kind of table, and the container fixing grooves 151 are provided to stably place dishes, drinking containers, or the like, on a surface of the tray 105.

One lateral surface of the tray 105 is rotatably mounted with respect to the main body 101. More specifically, a tray-fixing portion 111 is formed at an upper end portion of the main body 101 to be fixed to the tray 105, and a lower portion of the tray 105 is combined and fixed to the tray-fixing portion 111. Furthermore, the tray 105 is rotatably combined around the tray-fixing portion 111. Accordingly, when the tray 105 is rotated, the cap 102 may be opened or closed while using the tray 105.

Figure 2:
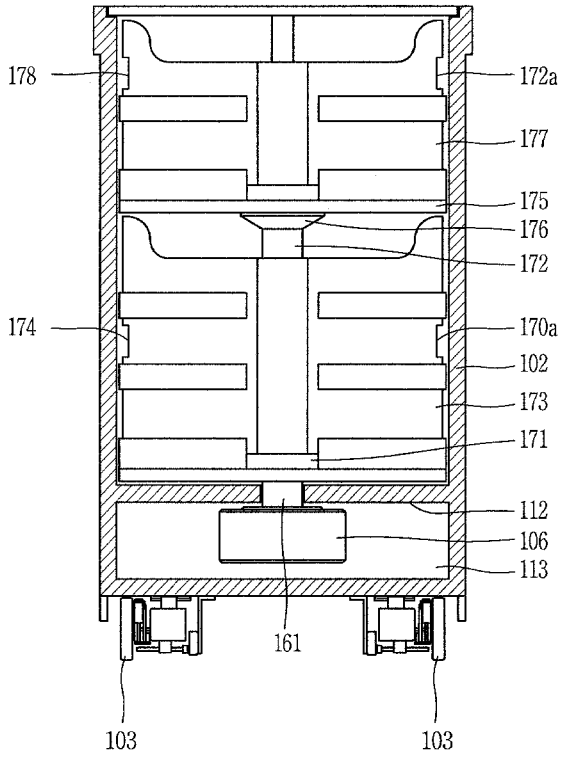
FIG. 2 is a partial cross-sectional view illustrating an internal structure of the main body.
Figure 3:
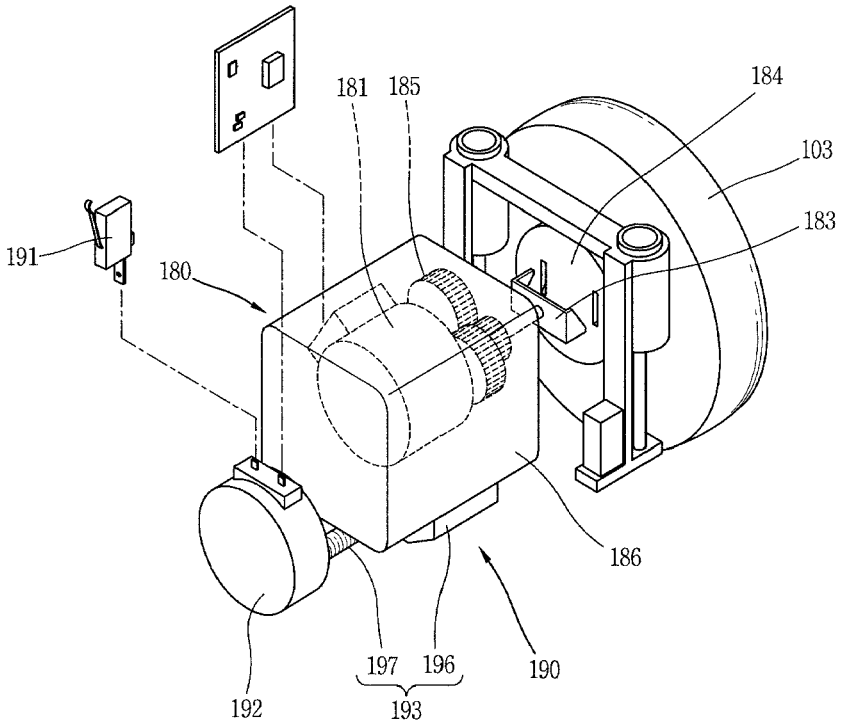
FIG. 3 is a perspective view illustrating a main body travel driving unit and a main body travel switching unit according to the present disclosure.
Figure 4:
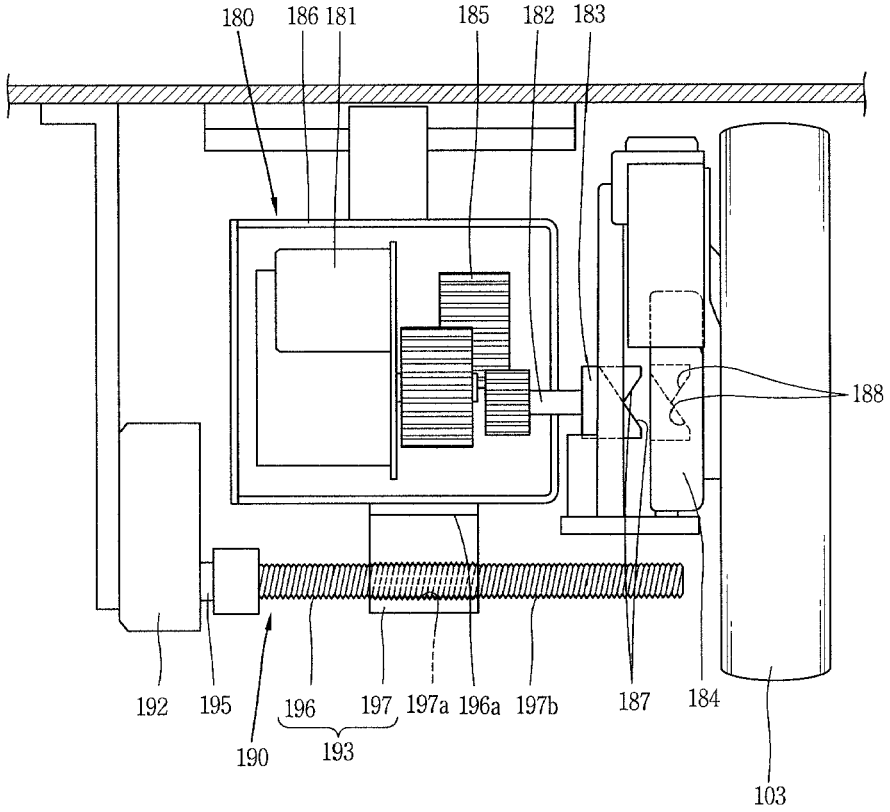
FIG. 4 is a front view illustrating one-sided units to explain a main body travel driving unit and a main body travel switching unit according to FIG. 3.

FIG. 2 is a partial cross-sectional view illustrating an internal structure of the main body, and FIG. 3 is a perspective view illustrating a main body travel driving unit and a main body travel switching unit according to the present disclosure, and FIG. 4 is a front view illustrating one-sided units to explain a main body travel driving unit and a main body travel switching unit according to FIG. 3. Referring to FIG. 2, a partitioning wall 112 is formed at a bottom portion of the main body 101, and a machine chamber 113 is formed between the partitioning wall 112 and the bottom portion of the main body 101. A freezing apparatus for providing a cooling function is installed in the machine chamber 113, but a freezing apparatus used in the existing refrigerator may be employed for the configuration of the freezing apparatus, and therefore, the detailed description thereof will be omitted.

On the other hand, a driving motor 106 is provided in the center of the machine chamber 113. A ball screw 161 extended to an internal space of the main body 101 through the partitioning wall 112 is mounted at a rotating shaft of the driving motor 106. A driving plate 107 is engaged with the ball screw 161. The driving plate 107 has a disk shape in which a hole (not shown) engaged with the ball screw 161 is formed in the middle portion thereof, and positioned in an internal space of the main body 101. The driving plate 107 is elevated upward or downward along a height direction of the main body 101 by the rotation of the ball screw 161.

The driving plate 107 may be completely protruded to an upper portion of the main body 101, and due to this, a first shelf and a second shelf to be described later may be protruded in an outward direction of the main body 101. In this state, the user is able to accommodate or take out a product within a basket mounted on the shelf. Moreover, most of the driving portion for taking out the driving plate 107 is positioned within the machine chamber, thereby providing a large storage space.

Here, the movement of the driving plate 107 may be manipulated through a manipulation button provided on the display window 104. The manipulation button is enabled to operate a driving motor only while controlling the operation of the driving motor 106 to press the manipulation button, or enabled to elevate the driving plate upward or downward as much as a predetermined height through one manipulation.

A first shelf 171 is positioned at an upper portion of the driving plate 107. The first shelf 171 may be placed at an upper portion of the driving plate 107 in the state of being inserted into an external side of the sleeve 172 provided at an external side of the ball screw 161, and may be rotated independently from the driving plate 107.

A second shelf 175 is positioned at an upper portion of the first shelf 171. The second shelf 175 may be placed at an upper portion of the support 176 fixed and provided at the sleeve 172, and may be freely rotated with respect to the sleeve 172 similarly to the first shelf.

Two baskets 173, 177 are provided at an upper portion of the shelves 171, 175, respectively. The baskets 173, 177 are formed in such a manner that the cross section thereof has a semicircular form, and a handle portion 174, 178 for allowing the user to easily grasp them while manually moving the movable refrigerator 100 is formed at a lateral surface thereof. Furthermore, the handle portion 174, 178 is formed to pass through an external wall of the baskets, respectively, and the external wall on a portion formed with the handle portion is preferably formed higher than the other portion thereof.

Referring to FIGS. 2 and 3, the main body travel driving unit 180 and the main body travel switching unit 190 may be provided out of the machine chamber 113 of the main body 101, but may be provided within the machine chamber.

The main body travel driving unit 180 is provided to automatically rotate the wheel 103 to move the main body 101. The main body travel driving unit 180 may include a travel motor 181 configured to generate a rotational force, a driving shaft 182 combined with a rotating shaft of the travel motor 181 to transmit a rotational force, a motor-side joint 183 provided at an end of the driving shaft 182, and a wheel-side joint 184 formed in an axial direction to be detachably joined to the motor-side joint 183 and provided at a central shaft of the wheel. Furthermore, a plurality of reduction gears 185 are provided between a rotating shaft of the travel motor 181 and a driving shaft 182 thereof to transmit a rotational force of the travel motor 181 to the driving shaft 182.

For the travel motor 181, a unidirectional rotation motor may be used but a bidirectional rotation motor may be used according to the manipulation method. Furthermore, the travel motor 181 may be provided within the motor box 186 that is placed in a free state with respect to the machine chamber 113 of the main body 101 to be moved in an axial direction along the carrier of the main body travel switching unit to be described later.

The driving shaft 182 is combined with the center of a driven gear constituting part of the reduction gear 185, and the motor-side joint 183 is formed to have a transmission surface 187 in one direction as illustrated in FIGS. 3 and 4. Furthermore, the wheel-side joint 184 is provided with a driven surface 188 to correspond to the transmission surface 187 of the motor-side joint 183, and formed in the center of the wheel 103.

Here, in order to allow the motor-side joint 183 and the wheel-side joint 184 to be faced all the time at the combining position, both the joints 183, 184 may be provided with a position sensor having a transmission unit and a receiving unit. Furthermore, the position sensor is electrically connected to a microcomputer for controlling the travel motor 181, and it may be preferable that the travel motor 181 always rotates the motorside joint 183 to its original position, i.e., a position that can be combined with the wheel-side joint 184.

The main body travel switching unit 190 turns on or off the main body travel driving unit 180 so as to switch its travel method in such a manner that the main body 101 is automatically or manually moved. The main body travel switching unit 190 may include a manipulation unit 191 configured to receive a travel method from the user, a switching motor 192 electrically connected to the manipulation unit 191 to generate power, and a power transmission unit 193 mechanically combined with the switching motor 192 to move the motorside joint 183 in a direction of being attached or detached to/from the wheel-side joint 184.

The manipulation unit 191 is provided on the display window 104 to be used as a manipulation button (not shown) for manipulating the main body 101.

The switching motor 192 is a rotation motor that rotates bidirectionally, and a rotating shaft 195 combined with a transmission shaft 196 of the power transmission unit 193 to be described later to transmit a rotational force to the transmission shaft 196 may be provided in the center of the rotation motor.

The power transmission unit 193 converts rotational motion of the switching motor 192 into linear motion. The power transmission unit 193 may include a transmission shaft 196 combined with a rotating shaft 195 of the switching motor 192 to transmit a rotational force, and a carrier 197 one side of which is combined with the transmission shaft 196 and the other side of which is combined with a motor box 186 of the main body travel driving unit 180 accommodating the driving shaft 182 to move the driving shaft 182 in a direction of being close to or away from the wheel 103 while being moved along an axial direction of the transmission shaft 196 during the rotation of the transmission shaft 196.

The transmission shaft 196 is formed in a direction similar to the driving shaft 182. Furthermore, a male screw portion 196*a* is formed on a circumferential surface of the transmission shaft 196 to move the carrier 197 in an axial direction.

An end of the carrier 197 is formed with a female screw portion 197*a* screw-combined with the male screw portion 196*a* of the transmission shaft 196 to be moved in an axial direction during the rotation of the transmission shaft 196 whereas the other thereof is formed with a fixing portion 197*b* combined with the motor box 186 accommodating the reduction gear 185 of the travel motor 181.

The process of allowing a movable refrigerator according to the present disclosure to be travelled is as follows.

Figure 5:
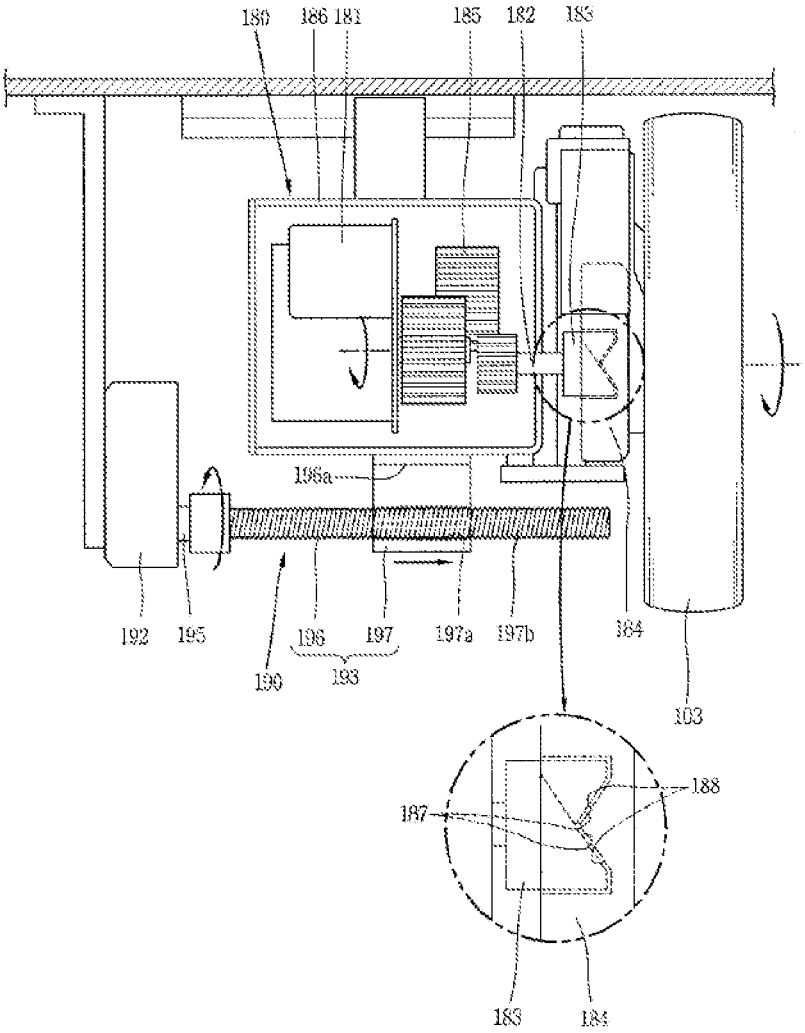
FIGS. 5 and 6 are front views illustrating the joining operation and separating operation of a main body travel driving unit and a main body travel switching unit according to FIG. 3.

In other words, as illustrated in FIG. 5, if the user selects automatic operation using a manipulation button of the manipulation unit 191, then the signal is transferred to the switching motor 192 to be rotated in a joining direction (for the sake of convenience, first direction). Then, the transmission shaft 196 combined with the rotating shaft of the switching motor 192 is rotated in a first direction, thereby allowing the carrier 197 to be moved to a side of the wheel 103.

Then, the motor box 186 combined with the carrier 197 is also moved to a side of the wheel 103, and the driving shaft 182 combined with the motor box 186 is moved to a side of the wheel 103 together with the motor box 186, thereby allowing the motor-side joint 183 to be combined with the wheel-side joint 184.

Then, the travel motor 181 starts to rotate, and the reduction gear 185 reduces a rotational force of the travel motor 181 to transmit the reduced rotational force to the driving shaft 182. Then, the motor-side joint 183 combined with the driving shaft 182 transmits a rotational force to the wheel-side joint 184, thereby allowing the wheel 103 to be rotated. Then, the movable refrigerator 100 will be automatically moved even when the user does not pull or push the movable refrigerator.

Figure 6:
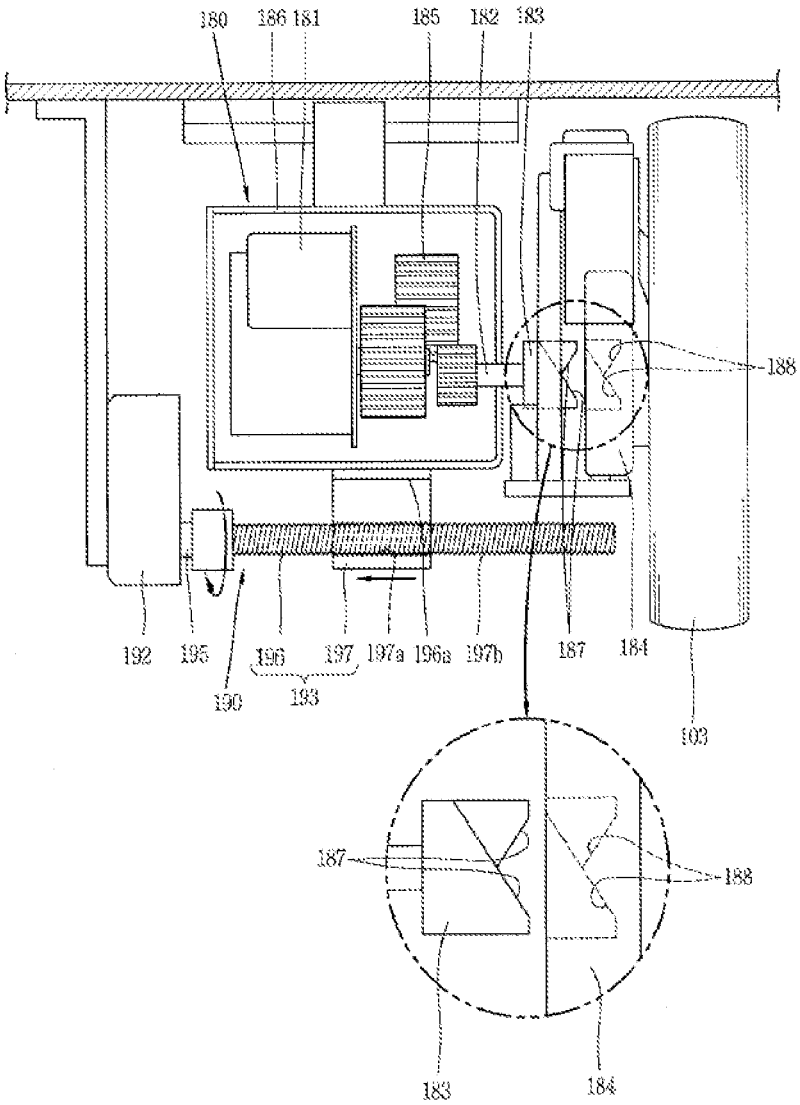

On the contrary, as illustrated in FIG. 6, if the user selects manual operation using a manipulation button of the manipulation unit 191, then the travel motor 181 stops and the switching motor 192 rotates in a separating direction (for the sake of convenience, second direction), thereby allowing the carrier 197 to be moved in a direction of being away from the wheel 103. Then, the motor-side joint 183 is separated from the wheel-side joint 184 while the motor box 186 is moved in a direction of being away from the wheel 103. Then, the movable refrigerator 100 will be in the state that cannot be automatically moved to be used when the user directly push or pull the movable refrigerator.

In such a manner, according to the movable refrigerator, the user may suitably select and use automatic operation and manual operation according to the user's healthy condition, the environment of the used place, or the need of use, thereby greatly enhancing the use convenience of a movable refrigerator.

The invention claimed is:

1. A movable refrigerator, comprising:

a main body having a storage space therein and provided with a wheel at a lower portion thereof;

a cooling apparatus provided within the main body to cool the storage space;

a shelf provided in the storage space to accommodate foods;

a main body travel driving unit configured to automatically rotate the wheel to move the main body; and a main body travel switching unit configured to turn on or off the main body travel driving unit to automatically or manually move the main body, wherein the main body travel driving unit comprises:

a motor box;

a travel motor accommodated into the motor box and configured to generate a rotational force;

a driving shaft connected to a rotating shaft of the travel motor and configured to transmit the rotational force of the travel motor, wherein an end of the driving shaft is exposed outside from the motor box;

a motor-side joint provided at the end of the driving shaft; and a wheel-side joint provided at a central shaft of the wheel and formed to be joined to the motor-side joint, wherein the main body travel switching unit comprises:

a manipulation unit configured to receive a type of an operation from a user;

a switching motor electrically connected to the manipulation unit to generate power; and a power transmission unit connected to the switching motor, wherein the power transmission unit comprises:

a carrier combined with the motor box and having a hole formed with a female screw portion; and a transmission shaft connected to a rotating shaft of the switching motor and penetrating the hole of the carrier, wherein a male screw portion is formed at an outer circumference of the transmission shaft and screw-combined with the female screw portion of the hole, wherein the motor box is configured to be movable in response to a movement of the carrier, such that the motor-side joint is moved in a direction to be attached or detached to or from the wheel-side joint, and wherein the wheel receives the rotational force of the travel motor while the motor-side joint is attached to the wheel-side joint.

2. The movable refrigerator of claim 1, wherein a plurality of reduction gears are provided between a rotating shaft of the travel motor and a driving shaft thereof to transmit a rotational force of the travel motor to the driving shaft.

3. The movable refrigerator of claim 1, wherein the motor-side joint and wheel-side joint are formed in an axial direction to be attached or detached to/from each other.

4. The movable refrigerator of claim 2, wherein the plurality of reduction gears are accommodated into the motor box.

5. The movable refrigerator of claim 1, wherein at least one handle is provided on the main body.

6. The movable refrigerator of claim 1, wherein the main body travel driving unit further comprises:

a position sensor having a transmission unit and a receiving unit, the transmission unit and the receiving unit provided at the motor-side joint and the wheel-side joint, respectively, wherein the position sensor is configured to control a rotation of the travel motor so as to allow the motor-side joint and the wheel-side joint to be faced each other.

7. The movable refrigerator of claim 1, wherein the travel motor is configured to:

start to rotate while the motor-side joint is attached to the wheel-side joint, and stop rotating while the motor-side joint is detached from the wheel-side joint.

* * * * *